US005223314A

United States Patent [19]

Watanabe et al.

[11] Patent Number: 5,223,314

[45] Date of Patent: Jun. 29, 1993

[54] COVER FILM FOR SUBLIMATION THERMAL-TRANSFER HARD COPY

[75] Inventors: Hideo Watanabe, Kawasaki; Kaoru Naito, Yokohama; Noriko Hiraga, Kawasaki, all of Japan

[73] Assignee: Nikon Corporation, Tokyo, Japan

[21] Appl. No.: 674,936

[22] Filed: Mar. 26, 1991

Related U.S. Application Data

[63] Continuation-in-part of Ser. No. 502,633, Apr. 2, 1990, abandoned.

[30] Foreign Application Priority Data

Mar. 27, 1990 [JP] Japan ..... 2-78374

[51] Int. Cl.[5] ..... B32B 7/02; B41J 2/32; B41J 29/00; B41M 5/38

[52] U.S. Cl. ..... 428/35.4; 428/34.3; 428/421; 428/448; 428/451; 428/510; 428/518; 428/203; 428/463; 428/212; 428/913; 503/227

[58] Field of Search ..... 428/421, 448, 451, 463, 428/212, 510, 518, 34.3, 35.4

[56] References Cited

FOREIGN PATENT DOCUMENTS 2-265793 10/1990 Japan .
4480242 10/1969 Switzerland .

*Primary Examiner*—P. C. Sluby
*Attorney, Agent, or Firm*—Shapiro and Shapiro

[57] ABSTRACT

A cover film for covering a hard copy produced by sublimation thermal-transfer image-forming has an anti-contamination layer with one side for contacting the hard copy, and a gas-impermeable layer provided to the other side of the anti-contamination layer.

39 Claims, 4 Drawing Sheets

COVER FILM FOR SUBLIMATION THERMAL-TRANSFER HARD COPY

This is a continuation-in-part of application Ser. No. 502,633 filed Apr. 2, 1990, now abandoned.

BACKGROUND OF THE INVENTION

1. Field of the Invention

The present invention relates to a cover film for a sublimation thermal transfer hard copy. The term "sublimation thermal transfer hard copy" is used in this specification to mean a hard copy of an image formed on an image receiving sheet by a sublimation thermal transfer method.

2. Related Background Art

Hitherto, an intense study has been made for developing methods for reproducing an image in the form of a hard copy similar to a photograph from electrical picture signals derived from, for example, a video camera, a still video camera, a television, a video disk and a photograph transmission system. Among these methods, a method called "sublimation thermal transfer (image) recording method" is now attracting attention.

Briefly, the sublimation thermal transfer recording method is a method in which electrical signals containing picture data are delivered to a thermal head having an array of electric heat generating elements arranged at a density of, for example, 4 to 16 dots (elements) per 1 mm, while an image-receiving sheet and an ink sheet superposed on the image-receiving sheet, the ink sheet being usually composed of a carrier sheet and a sublimation dyestuff layer on the carrier sheet, are moved together in contact with the head, so that the dyestuff is transferred in the form of a dot pattern from the ink sheet to the image-receiving sheet, whereby a hard copy is produced.

The thus obtained sublimation thermal transfer hard copies are usually stored in an office file, e.g., on a sheet of paper, in a notebook, a book, a scrap book, a card case, a letter case, and so forth, according to the uses of the hard copies.

When a sublimation thermal transfer copy is left for a long time with the image surface held in contact with an office file, the sublimation-type dyestuff sublimating from the image surface of the hard copy undesirably contaminates the portion of the office file contacting the hard copy.

In addition, discoloration or change in the color of the thus obtained hard copy image tends to be caused due to influence of heat, light or contact with gases, thus making it impossible to store the hard copy in good order.

SUMMARY OF THE INVENTION

In the cover film in accordance with the present invention, a layer of an anti-contamination material has a surface for contacting the image surface of the sublimation thermal-transfer hard copy, and a layer of a gas-impermeable material is provided to the other side of the anti-contamination layer. The anti-contamination layer may be constituted, for example, by a sheet of anti-contamination material or a coating of anti-contamination material formed on a carrier layer; and the gas-impermeable layer may be constituted, for example, by a sheet of gas-impermeable material or a coating of gas-impermeable material on a carrier layer.

According to the invention, coloring of the cover film is prevented even after a long covering of a sublimation thermal-transfer hard copy, by virtue of the layer of an anti-contamination material contacting the image surface of the sublimation thermal-transfer hard copy. Thus, the cover film may be used repeatedly for storing different copies. Furthermore, dye resublimated from the sublimation thermal-transfer hard copy does not penetrate the cover film, because the layer of a gas-impermeable material is provided to the other side of the anti-contamination layer. Consequently, contamination of an object which has happened to be brought into contact with the hard copy is avoided, as is invasion of external gases which tend to cause degradation of the image quality, such as steam, oxygen and ozone.

The anti-contamination material is preferably composed of a resin which has no affinity to the sublimation-type dyestuff, such as a polymeric material having a solubility parameter (referred to as "SP value", hereinafter) which is not greater than 8.5, and which is not smaller than 15.0.

The SP value is a value which is widely used as an index of the degree of chemical affinity or solubility between two or more substances. The smaller the SP value, the lower the affinity.

Examples of polymeric substances having SP values not greater than 8.5, suitable for use in the present invention, are silicone resin, Teflon resin, polyethylene and polypropylene. On the other hand, examples of polymeric substances having SP values not smaller than 15.0 are cellophane, hydrophilic resins such as polyvinylalcohol, and so forth.

Generally, resins having small permeability to steam and oxygen are suitably used as the gas-impermeable material in the invention. Such resins preferably have oxygen and steam permeability of $50 \times 10^{-13}$ $cm^3 \cdot cm/cm^2 \cdot sec \cdot cmHg$ or less, more preferably $30 \times 10^{-13}$ $cm^3 \cdot cm/cm^2 \cdot sec \cdot cmHg$ or less. Examples of such resins are polyvinylidene chloride, polyester, polyvinylchloride, polyvinylfluoride and so forth.

The cover film of the present invention also is effective in preventing discoloration or change in color due to irradiation with light, by virtue of an ultraviolet-ray absorption agent contained in either one of the anti-contamination layer and the gas-impermeable layer. Preferably, the ultraviolet ray absorption agent is capable of absorbing ultraviolet rays of wavelengths ranging between 300 and 400 nm. Compounds of benzo-phenone type, benzotriazole type and salicylate type are suitably used as the ultraviolet ray absorption agent.

Various methods are usable for producing the cover film of the present invention. For instance, the cover film can be formed by applying a liquid containing a gas-impermeable component to an anti-contamination film, or by applying a liquid containing an anti-contamination component to a gas-impermeable film. It is also possible to obtain the cover film of the invention by bonding an anti-contamination film and a gas-impermeable film to each other. The ultraviolet ray absorption agent may be mixed beforehand in the film-making process or may be added during application of the anti-contamination or gas-impermeable material. The thickness of each of the anti-contamination layer and the gas-impermeable layer preferably ranges between 2 and 100 μm, more preferably between 5 and 200 μm. The total thickness of the cover film generally ranges between 5 and 200 μm, preferably 20 and 100 μm.

According to the present invention, it is possible to provide a writable layer (i.e., a layer for written notations) on the side thereof having the gas-impermeable material, so as to facilitate filing of the sublimation thermal-transfer hard copy.

The writable layer can be formed by applying, to the gas-impermeable layer, a coating liquid which contains a polymer and an inorganic filler such as titanium oxide, clay or the like, or an organic filler such as silicone resin, epoxy resin or the like. Specifications of the sublimation thermal-transfer hard copy, such as the content, date and so forth, can easily be written on the writable layer by means of a pencil, a ball-point pen, or the like.

Application of liquids in the process for producing the cover film of the present invention may be conducted by means of a reverse coater, roll coater or a gravure coater.

DESCRIPTION OF THE PREFERRED EMBODIMENTS

Figure 1:
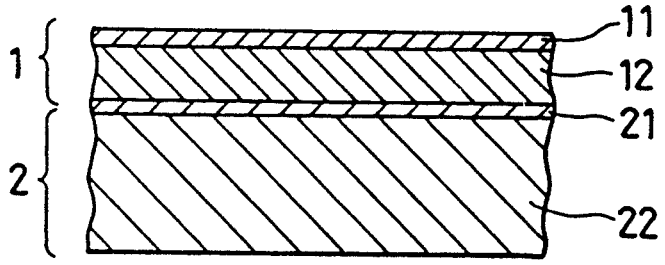
FIG. 1 is a longitudinal sectional view of a first embodiment of the cover film of the present invention, in a state in which the cover film composed of a gas-impermeable layer and a carrier layer of an anti-contamination substance is held in close contact with a sublimation thermal-transfer hard copy.

FIG. 1 shows a first embodiment of the cover film 1 of the present invention composed of a gas-impermeable layer 11 and a carrier layer 12 of an anti-contamination substance, the cover film being superposed on an image-receiving layer 21 of a sublimation thermal transfer hard copy 2 in contact therewith.

The illustrative sublimation thermal-transfer hard copy was formed by sublimation thermal transfer process conducted with an ink sheet and an image-receiving sheet 22 in accordance with the following procedure.

(Production of sublimation thermal-transfer hard copy)

(1) Preparation of ink sheet

A mixture liquid was prepared to have the following composition:

| | |
|---|---|
| Sublimation dyestuff (C.I. Disperse Red 60) | 5 wt parts |
| Ethylcellulose | 5 wt parts |
| Methylethylketone | 90 wt parts |

The mixture liquid was stirred in a bowl mill for 20 hours for dispersion, and was applied by means of a wire bar to a polyester film (carrier sheet) 6 μm thick, so that a sublimation dyestuff layer 1 μm thick was formed.

A silicone resin layer 0.5 μm thick was formed as a heat-resistant layer on the side of the carrier sheet opposite to that having the sublimation dyestuff layer.

(2) Preparation of image-receiving sheet

A coating liquid was formed to have the following composition:

| | |
|---|---|
| Aqueous emulsion of polyester resin (byronal-1200: produced by Toyobo Kabushiki Kaisha) | 30 wt parts |
| Silicone oil (SF-8421: produced by Toray silicone) | 1 wt part |
| Ethylalcohol | 30 wt parts |
| Water | 39 wt parts |

The coating liquid thus prepared was applied by a wire bar to a carrier sheet which was a synthetic paper (Corpo: produced by Ohji Yuka Kabushiki Kaisha, 130 μm thick), followed by 5-hour drying at 80° C., whereby an image-receiving sheet having a dyestuff image-receiving layer of 3 μm was obtained.

(3) Thermal-transfer recording

The ink sheet mentioned above was superposed on the image-receiving sheet such that the sublimation dyestuff layer contacted the image-receiving layer, and a thermal head (0.2 W/dot) was pressed onto the ink sheet while electrical power was supplied to the thermal head for a period of 10 msec, whereby a red image having an image density of 1.6 was obtained. The thus obtained sublimation thermal-transfer copy is common to the embodiments of the invention described hereinafter.

(First embodiment)

To prepare the aforementioned cover film of FIG. 1, a coating liquid was applied by a wire bar to a sheet 12 of cellophane 40 μm thick serving as a carrier layer of anti-contamination material. The coating was then dried to form a gas-impermeable layer 11 of 5 μm thickness and capable of absorbing ultraviolet rays, whereby the cover film was obtained. The composition of the coating liquid was as follows:

| | |
|---|---|
| 2(2'-hydroxy-3',5'-di-tert-butylphenyl)-5-chlorobenzotriazole | 1 wt part |
| Polyester resin (Byron-200, produced by Toyobo) | 15 wt parts |
| Methylethylketone | 34 wt parts |
| Toluene | 50 wt parts |

The following experiment was conducted on this cover film.

(Anti-contamination and shelving tests)

The cover film 1 was laid on the sublimation thermal-transfer hard copy 2 such that the cellophane layer of the cover film 1 closely contacted the image-receiving layer 21 of the hard copy 2. Then, a sheet of white paper was laid on the gas-impermeable layer 11. The hard copy 2 with cover film 1 was shelved in an oven at a temperature of 50° C. under application of a pressure of 10 g/cm$^2$ on the white paper.

A test also was conducted in which the cellophane of the cover film 1 was held in close contact with the image-receiving layer 21 at 50° C. and in an atmosphere of RH 80%. A test also was conducted in which the laminate of the hard copy 2 and the cover film 1 with the cellophane layer of the cover film 1 closely contacting the image-receiving layer 21 was exposed to outdoor solar light throughout one month (October). Change in the density of the sublimation thermal-transfer image density was examined after the shelving and exposure, and the results are shown in Table 1.

(Second Embodiment)

Figure 2:
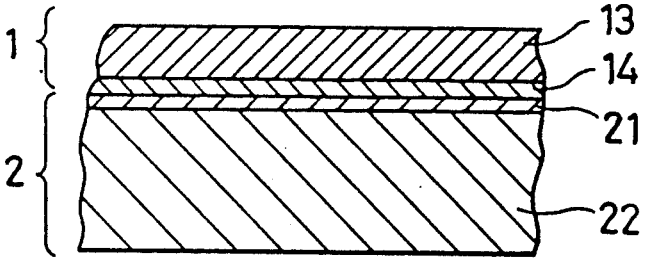
FIG. 2 is a longitudinal sectional view of a second embodiment of the cover film of the present invention, in a state in which the cover film composed of a carrier layer of a gas-impermeable substance and an anti-contamination layer is held in close contact with a sublimation thermal-transfer hard copy.

FIG. 2 shows a second embodiment of the cover film 1 of the present invention having an anti-contamination layer 14 formed on a carrier layer 13 of gas-impermeable material, the cover film 1 being held in close contact with the image-receiving layer 21 of the sublimation thermal-transfer hard copy 2.

A liquid having the following composition was prepared.

| | |
|---|---|
| Polyvinylalcohol (PVA-117: produced by Kuraray) | 10 wt parts |
| Water | 90 wt parts |

The liquid was applied by a wire bar to a polyvinyl chloride film (carrier layer of gas-impermeable substance) 50 μm thick containing an ultraviolet ray absorbing substance, whereby a cover film 1 having an anti-contamination layer 14 of 5 μm thickness was obtained. The thus-obtained cover film 1 was subjected to the same tests as those conducted on the first embodiment to obtain results as shown in Table 1.

(Third Embodiment)

Figure 3:
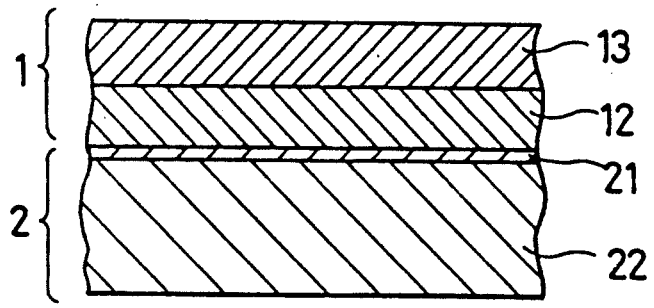
FIG. 3 is a longitudinal sectional view of a third embodiment of the cover film of the present invention, in a state in which the cover film composed of a layer of a gas-impermeable sheet material and a layer of an anti-contamination sheet material is held in close contact with a sublimation thermal-transfer hard copy.

FIG. 3 shows a third embodiment of the cover film 1 of the present invention having a layer 13 of a gas-impermeable material and a layer 12 of an anti-contamination material, the cover film 1 being laid on the image-receiving layer 21 of the sublimation thermal-transfer hard copy 2 in close contact therewith.

This cover film was prepared by bonding a cellophane sheet 12 of 40 μm thickness to a polyvinyl-chloride film 13 having a thickness of 50 μm and containing an ultraviolet ray absorbing agent. In this embodiment, bonding of the sheets 12 and 13 is not essential and these sheets may simply be superposed depending on use. This embodiment was not tested because satisfactory performance of this embodiment can obviously be expected from the results of tests conducted on the first and second embodiments.

Comparison examples were prepared as follows, for the purpose of comparison with the cover film 1 of the invention.

(First Comparison Example)

A nylon film 15 μm thick (Harden: produced by Toyobo) having excellent gas-impermeability was used as the cover film and tested in the same manner as the first embodiment.

Second Comparison Example)

A polypropylene film of 20 μm thick (Torayfan: produced by Toray) having excellent gas-impermeability was used as the cover film and tested in the same manner as the first embodiment.

(Third Comparison Example)

The same tests as those conducted on the first embodiment were carried out without using a cover film, by way of comparison.

The results of tests on these comparison examples also are shown in Table 1.

TABLE 1

| | First Embodiment | Second Embodiment | First Comp. Example | Second Comp. Example | Third Comp. Example |
|---|---|---|---|---|---|
| Coloring of Cover film | ○ | ○ | X | Δ | — |
| Coloring of paper | ○ | ○ | ○ | X | X |
| Image density after 1-month preservation at 50° C., 80 RH % | 1.59 | 1.61 | 1.57 | 1.53 | 1.48 |
| Density after 1-month Exposure to light | 1.55 | 1.54 | 1.36 | 1.32 | 1.21 |

Notes:

Symbol ○ represents no coloring, Δ represents slight coloring and X represents heavy coloring.

The density figures show the preservation characteristic and represent image density after preservation of the sublimation thermal-transfer hard copy which had a density of 1.6.

From Table 1, it will be seen that there was no coloring of the cover films of the first and second embodiments, nor of the paper contacting the cover films. Thus, the films are usable repeatedly, by virtue of the provision of the anti-contamination layer and the gas-impermeable layer. It will also be seen that these cover films enable images to be preserved in good order. The cover film of the first comparison example does not allow coloring of the paper but tends to be colored easily. This cover film, therefore, cannot be used for other image samples. The cover film of the second comparison example exhibits a reduced tendency of being colored but is inferior in the gas-impermeability and, hence, tends to allow the sublimating dyestuff to permeate therethrough, resulting in coloring of the paper contacting this film.

Figure 4:
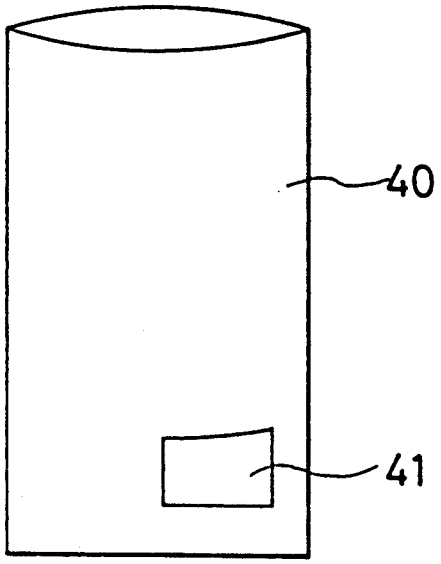
FIG. 4 is an illustration of a sack formed of a cover film in accordance with the present invention.

FIG. 4 is an illustration of the cover film of the invention in the form of a sack. The sack 40 of the cover film has an inner surface constituted by an anti-contamination layer. The outer surface of the sack is provided by a gas-impermeable layer or a carrier layer carrying a gas-impermeable substance. A writable layer 41 is provided on the outer surface of the sack.

Figure 5:
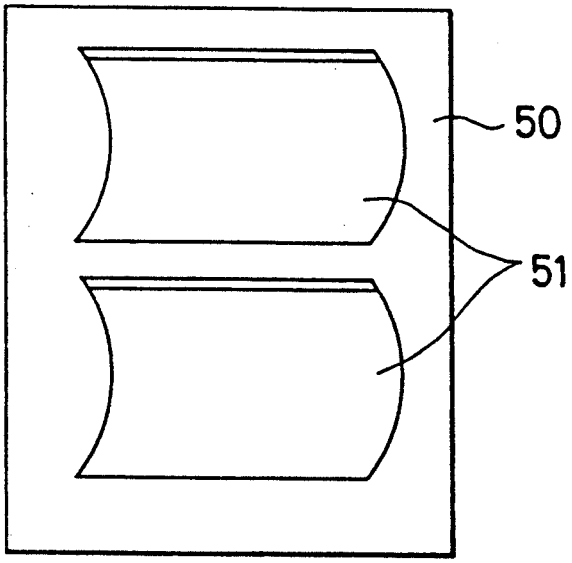
FIG. 5 is an illustration of an example of use of the cover film of the present invention, wherein a sublimation thermal-transfer hard copy is sandwiched between the cover film and a base paper sheet to which is cover film is fixed.

FIG. 5 shows one manner in which a cover film is fixed to a base paper and the sublimation thermal-transfer hard copy is inserted between the base paper and the cover film.

The cover film 51 is fixed to the base paper 50 such that the anti-contamination layer faces the base paper. The other surface of the cover film 51 is presented by a gas-impermeable layer or a carrier layer carrying a layer of gas-impermeable substance. Although not shown, a writable layer 41 may be provided on the outer surface of this cover film 51.

Fourth to ninth embodiments of the present invention will now be described.

In the fourth to ninth embodiments of the cover film of the present invention, the anti-contamination material, which is used as the material of the layers denoted by 31*e*, 33*a*, 33*b* and 33*c* in FIGS. 6 to 11, is selected from a thin film of an inorganic material, a thin film of a metal and a thin film of an organic polymeric material having a glass transition point Tg not lower than 80° C.

Examples of the inorganic materials are metal oxides such as silicon oxide, indium oxide, titanium oxide and aluminum oxide. Examples of the metal are Al, Cu, Ag, Ni and so forth. Thin films of these materials can be formed by evaporation deposition or sputtering. Examples of the organic polymeric material having a glass transition temperature Tg not lower than 80° C. are polystyrene, polycarbonate, acrylic resin, polyamide, polyimide, polyether sulfone and polyphenylenesulfide.

In the fourth to ninth embodiments of the cover film of the present invention, the gas-impermeable material, which is used as the material of the layers denoted by 31*b*, 32*a* and 32*b* in FIGS. 6 to 11, is an organic polymeric material having an oxygen permeability not greater than 150 $cc/m^2-24$ hr-atm/25 μm ($=5.7\times10^{-13}cm^3\cdot cm/cm^2\cdot sec\cdot cm$ Hg) and a steam permeability not greater than 100 $g/m^2-24$ hr/25 μm ($=3.8\times10^{-13}cm^3$. $cm/cm^2\cdot sec\cdot cm$ Hg). Examples of such an organic polymeric materials are polyvinylidene chloride, polyester, nylon, polyvinyl chloride, polyvinyl fluoride, polyacrylonitrile, and so forth.

Figure 6:
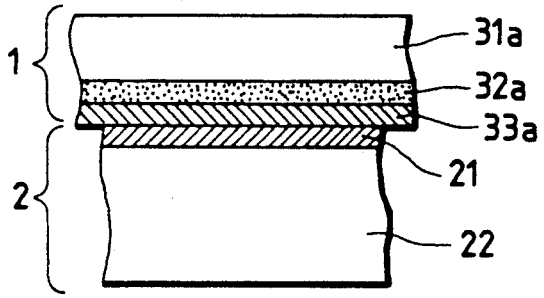
FIGS. 6, 7, 8, 9, 10 and 11 are longitudinal sectional views of cover films of fourth, fifth, sixth, seventh, eighth and ninth embodiments held in close contact with hard copies.
Figure 8:
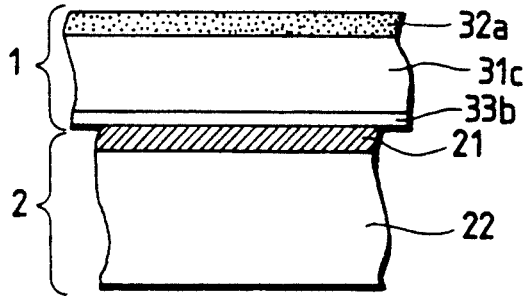
Figure 9:
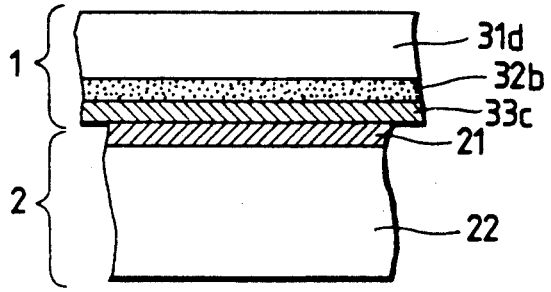

The transparent carriers used in the fourth, sixth and eighth embodiments, denoted by 31*a*, 31*c* and 31*d* in FIGS. 6, 8 and 9, are generally made of plastic films and are not required to have anti-contamination or gas-impermeable characteristics.

The fourth to ninth embodiments of the cover film of the present invention can be produced by various methods. For example, the cover film can be formed by sequentially applying a solution containing a gas-impermeable material and a solution containing anti-contamination material to a surface of a transparent substrate so as to laminate the gas-impermeable layer and the anti-contamination layer.

The film also can be produced by bonding a layer of an anti-contamination sheet material to a layer made of a gas-impermeable sheet material, or by using a carrier sheet of either one of a gas-impermeable material and an anti-contamination material, while applying thereto a solution of the other material. (Production of Sublimation Thermal-transfer Hard Copy)

(1) Preparation of ink sheet

This was done in the same way as for the first to third embodiments.

(2) Preparation of image receiving sheet

This was done in the same way as for the first to third embodiments.

(3) Thermal-transfer recording

As in first to third embodiments, the ink sheet and the image receiving sheet were superposed such that the sublimation dye layer of the ink sheet and the dye image receiving layer of the image receiving sheet contacted each other, and a thermal head (0.22 W/dot) was pressed across the ink sheet. Electrical power was supplied for 10 msec to effect a thermal-transfer recording, thus obtaining a red color image having an image density of 1.7.

(Fourth Embodiment)

FIG. 6 shows the fourth embodiment of the cover film 1 held in close contact with the image receiving layer 21 of the sublimation thermal-transfer hard copy 2. The cover film 1 has a transparent carrier 31*a*, and an ultraviolet-absorbing gas-impermeable layer 32*a* and an organic polymeric anti-contamination layer 33*a* formed by application of solutions.

More specifically, the cover film 1 shown in FIG. 6 was formed by the following process.

A coating solution was prepared to have the following composition:

| | |
|---|---|
| 2-hydroxy-4-methoxy-benzophenone: | 3 wt parts |
| polyester resin (Byron-200, produced by Toyobo): | 15 wt parts |
| Methylethylketone: | 31 wt parts |
| Toluene: | 50 wt parts |

The coating solution thus prepared was applied by a wire bar on a polypropylene film (transparent carrier 31*a*) 40 μm thick and was then dried to form an ultraviolet-absorbing gas-impermeable layer (ultraviolet-absorbing gas impermeable layer 32*a*) 2 μm thick.

Then, a coating solution having the following composition was applied to the surface of the ultraviolet-absorbing gas-impermeable layer 32*a* and dried so as to form an anti-contamination layer (organic polymeric anti-contamination layer 33*a*) 2 μm thick:

| | |
|---|---|
| Styrene resin: | 10 wt parts |
| Methylethylketone: | 40 wt parts |
| Toluene: | 50 wt parts |

(Anti-contamination and shelving tests)

The cover film 1 was superposed on the sublimation thermal-transfer hard copy 2 such that the image receiving layer 21 of the hard copy 2 and the anti-contamination layer 33*a* of the cover film 1 closely contacted with each other. Then, a white paper was superposed on the polypropylene film (transparent carrier 31*a*) of the cover film and a load of 10 $g/cm^2$ was applied to the white paper. The hard copy 2 and the cover film 1 were held in this state for 1 month in an oven maintaining an atmosphere of 50° C. for the purpose of examination of the anti-contamination characteristic.

A shelving test also was conducted in which the sublimation thermal-transfer hard copy 2 and the cover film 1 were shelved for 1 month in an atmosphere of 50° C., 80%RH, with their image receiving layer 21 and the anti-contamination layer 33*a* held in close contact with each other, as was a test in which the sublimation thermal-transfer hard copy 2 and the cover film 1 were held in contact with each other were subjected to 30-hour exposure by, a Fadeometer. The test results are shown in Table 2.

(Fifth Embodiment)

Figure 7:
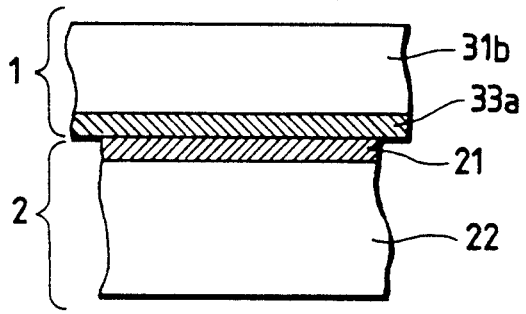

FIG. 7 shows a fifth embodiment of the cover film 1 held in close contact with an image receiving layer 21 of a sublimation thermal-transfer hard copy 2, the cover film 1 being composed of an organic polymeric anti-contamination layer 33*a* and an ultraviolet-absorbing gas-impermeable transparent carrier layer 31*b*. The cover film 1 shown in FIG. 7 was prepared by the following process.

A coating solution was prepared to have the following composition:

| | |
|---|---|
| Acrylic resin: | 10 wt parts |
| Methylethylketone: | 40 wt parts |
| Toluene: | 50 wt parts |

The coating solution was applied by a wire bar to a polyvinyl chloride film 50 μm thick containing an ultraviolet-absorbing agent (ultraviolet-absorbing gas-impermeable transparent carrier 31*b*) and was dried to form an anti-contamination layer (organic polymeric anti-contamination layer 33*a*) 3 μm thick.

This cover film was tested in the same manner as the fourth embodiment.

(Sixth Embodiment)

FIG. 8 shows a sixth embodiment of the cover film 1 of the present invention held in close contact with an image receiving layer 21 of a sublimation thermal-transfer hard copy 2. The cover film 1 has a transparent carrier layer 31*c*, and an ultraviolet-absorbing gas-impermeable layer 32*a* and a metallic thin film forming an anti-contamination layer 33*b* which were formed sequentially on the transparent carrier 31*c* by application of solutions.

The cover film 1 shown in FIG. 8 was prepared by forming, on a polyester film 38 μm thick, an anti-contamination layer of Al (anti-contamination thin metallic film layer 33*b*) of 200 Å by evaporation deposition. An ultraviolet-absorbing gas-impermeable layer 32*a* the same as that used in the fourth embodiment was formed on the opposite side of the polyester film. The thus-formed cover film was tested in the same way as the fourth and fifth embodiments.

(Seventh Embodiment)

FIG. 9 shows a seventh embodiment of the cover film 1 of the present invention. The cover film 1 of this embodiment was formed by providing an ultraviolet-absorbing gas-impermeable layer 32*b* formed on a nylon film (transparent carrier 31*d*) 40 μm thick, and then forming, on the ultraviolet-absorbing gas-impermeable layer 32*b*, an anti-contamination layer (anti-contamination layer 33*c* of inorganic material) 1 μm thick by vacuum evaporation. The ultraviolet-absorbing gas-impermeable layer 32*b* was formed in the same manner as that used in the fourth embodiment except that the 2-hydroxy-4-methoxy-benzophenone used in the fourth embodiment was substituted by 2(2'-hydroxy-3',5'-di-tert-butylphenyl)-5-chlorobenzotriazole. The thus-formed cover film was tested in the same way as the preceding embodiments.

(Eighth Embodiment)

Figure 10:
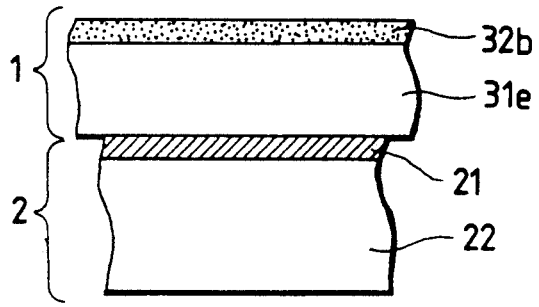

FIG. 10 shows an eighth embodiment of the present invention. The cover film 1 of this embodiment was produced by providing, on a polyphenylene, sulfide film (anti-contamination transparent carrier layer 31*e*) 10 μm thick, an ultraviolet-absorbing gas-impermeable layer 32*b* formed in the same manner as that used in the seventh embodiment. The thus-formed cover film was tested in the same way as the preceding embodiments.

(Ninth Embodiment)

Figure 11:
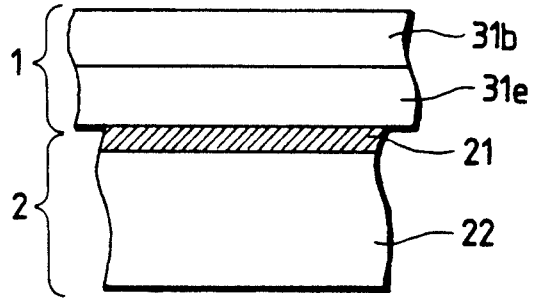

FIG. 11 shows the ninth embodiment of the cover film 1 of the present invention. The cover film 1 of this embodiment was produced by bonding a polyvinyl chloride film containing an ultraviolet-absorbing agent (ultraviolet-absorbing gas-impermeable transparent layer 31*b*) and having a thickness of 50 μm with a polyphenylene sulfide film (anti-contamination transparent layer 31*e*) 10 μm thick. These films need not always be bonded together. That is, in some uses, these films may be merely superposed without being bonded. The ninth embodiment of the cover film 1 was not tested because it was considered that the results of testing this film are predictable from the results of the tests of the fifth and eighth embodiments.

The following cover films were prepared as comparison examples, in addition to the first to third comparison examples previously discussed, for the purpose of comparison with the cover films of the fourth to eighth embodiments.

(Fourth Comparison Example)

A polyester film of 25 μm having a high gas-impermeability was used as a cover film and tested in the same way as the fourth embodiment.

(Fifth comparison Example)

A polyvinylalcohol film of 20 μm having superior anti-contamination characteristic was used as a cover film and tested in the same way as the fourth embodiment.

(Test Results)

Table 2 shows the results of the tests conducted for the purpose of examining the anti-contamination and shelving characteristics of the cover films of the fourth to eighth embodiments and the third to fifth comparison examples.

In Table 2, the same symbols are used to denote the same degrees of coloring contamination as were used in Table 1. The values of density show the shelving characteristic and indicate image density after preservation of the sublimation thermal-transfer hard copy which had a density value of 1.7.

TABLE 2

| | Embodiments | | | | | Comp. Example | | |
|---|---|---|---|---|---|---|---|---|
| | 4th | 5th | 6th | 7th | 8th | 3rd | 4th | 5th |
| Coloring of cover film | o | o | o | o | o | — | x | o |
| Coloring of paper | o | o | o | o | o | x | o | o |
| Image density after 1-month preservation at 50° C., 80 RH % | 1.69 | 1.67 | 1.71 | 1.74 | 1.67 | 1.48 | 1.67 | 1.53 |
| Density after 1-month exposure to Fadeometer | 1.55 | 1.59 | 1.67 | 1.62 | 1.64 | 1.21 | 1.36 | 1.32 |

As will be seen from Table 2, in the cases of fourth to eighth embodiments, coloring of the cover film was prevented and contamination of the paper contacting the sublimation thermal-transfer hard copy was avoided. In addition, the shelving characteristic of the image was superior.

From Table 2, it will also be appreciated that the cover film of the fourth comparison example provided a good anti-contamination characteristic; but this cover film itself was colored and, hence, cannot be used repeatedly for different sublimation thermal-transfer hard copies. Furthermore, the cover film of the fifth comparison example was permeable to steam so that it undesirably allowed image degradation under conditions of high-temperature and moisture, although the coloring of the film itself was not noticeable. The third and fourth comparison examples were inferior in anti-light characteristic, although they provided greater resistances to heat and moisture as compared with the case where no cover film was used, as in the fifth comparison example.

Thus, the fourth to ninth cover films of the present invention offer the following advantages.

Coloring of the cover film is prevented by virtue of the anti-contamination layer. This means that no trace of the sublimation thermal-transfer hard copy remains on the cover film so that the cover film can be used repeatedly for covering different sublimation thermal-transfer hard copies. In addition, the ultraviolet-absorbing gas-impermeable layer prevents dye re-sublimated from the sublimation thermal-transfer hard copy from penetrating the cover film, thus avoiding contamination of objects which have been brought into contact with the hard copy. In addition, fading of the image is suppressed because invasion by external gases such as steam, oxygen and ozone is suppressed and ultraviolet rays are absorbed.

The cover films, when put to practical use, are treated and processed in the manner shown in FIGS. 4 and 5, as in the cases of the first to third embodiments.

As has been described herein, it is possible according to the present invention to obtain a cover film which has anti-contamination and gas-impermeable characteristics, and which is also capable of absorbing ultraviolet rays, thus greatly facilitating storage and administration of sublimation thermal-transfer hard copies.

It is also possible to write data concerning the hard copy when a writable layer is provided, thus further facilitating administration and preservation of the hard copies.

The storage and administration of sublimation thermal-transfer hard copies are further facilitated when the cover film is formed as a sack or fixed to a base paper.

What is claimed is:

1. A cover film for covering the image surface of a sublimation thermal-transfer hard copy, comprising:

an anti-contamination layer which provides a surface of said cover film that faces said image surface; and a gas-impermeable layer providing an opposite surface of said cover film.

2. A cover film according to claim 1, wherein said anti-contamination layer is a carrier layer of anti-contamination sheet material and said gas-impermeable layer is a coating of gas-impermeable material on a surface of said carrier layer.

3. A cover film according to claim 2, wherein said gas-impermeable layer has oxygen- and steam-permeabilities not higher than $30\times10^{-13}cm^3\cdot cm/cm^2\cdot cmHg$.

4. A cover film according to claim 1, wherein said gas-impermeable layer is a carrier layer of gas-impermeable sheet material and said anti-contamination layer is a coating of anti-contamination material on a surface of said carrier layer.

5. A cover film according to claim 1, wherein said anti-contamination layer has a solubility parameter which is not greater than 8.5.

6. A cover film according to claim 1, wherein said anti-contamination layer is a layer of anti-contamination sheet material and said gas-impermeable layer is a layer of gas-impermeable sheet material.

7. A cover film according to claim 1, including a layer of writing material formed on said opposite surface.

8. A cover film according to claim 1, wherein at least one of said anti-contamination layer and said gas-impermeable layer contains an ultraviolet ray absorbing agent.

9. A cover film according to claim 1, and which is in the form of a sack.

10. A cover film covering the image surface of a sublimation thermal-transfer hard copy, comprising:

a transparent carrier layer;

a layer of gas-impermeable material provided on a surface of said transparent carrier that faces the image surface of said sublimation thermal-transfer hard copy; and a layer of anti-contamination material laminated on said layer of said gas-impermeable material.

11. A cover film according to claim 10, wherein said anti-contamination material is an inorganic material, a metal or an organic polymeric material having a glass transition temperature not lower than 80° C.

12. A cover film according to claim 10, wherein said gas-impermeable material includes an ultraviolet absorbing agent.

13. A cover film according to claim 10, wherein said gas-impermeable material is an organic polymeric material having an oxygen permeability not greater than 150 $cc/m^2-24$ hr-atm/25 μm and steam permeability not greater than 100 $g/m^2-24$ hr/25 μm.

14. A cover film according to claim 10, wherein said anti-contamination material is an inorganic material, a metal or an organic polymeric material having a glass transition temperature not lower than 80° C., and wherein said gas-impermeable material is an organic polymeric material having an oxygen permeability not greater than 150 $cc/m^2-24$ hr-atm/25 μm and steam permeability not greater than 100 $g/m^2-24$ hr/25 μm.

15. A cover film covering the image surface of a sublimation thermal-transfer hard copy, comprising:

a transparent carrier layer;

a layer of anti-contamination material provided on a surface of said transparent carrier layer and contacting the image surface of said sublimation thermal-transfer hard copy; and a layer of gas-impermeable material provided on an opposite surface of said transparent carrier layer.

16. A cover film according to claim 15, wherein said anti-contamination material is an inorganic material, a metal or an organic polymeric material having a glass transition temperature not lower than 80° C.

17. A cover film according to claim 15, wherein said gas-impermeable material includes an ultraviolet absorbing agent.

18. A cover film according to claim 15, wherein said gas-impermeable material is an organic polymeric material having an oxygen permeability not greater than 150 $cc/m^2-24$ hr-atm/25 μm and steam permeability not greater than 100 $g/m^2-24$ hr/25 μm.

19. A cover film according to claim 15, wherein said anti-contamination material is an inorganic material, a metal or an organic polymeric material having a glass transition temperature not lower than 80° C., and wherein said gas-impermeable material is an organic polymeric material having an oxygen permeability not greater than 150 cc/m$^2$−24 hr-atm/25 μm and steam permeability not greater than 100 g/m$^2$−24 hr/25 μm.

20. A cover film according to claim 15, wherein at least one of said layer of anti-contamination material and said layer of gas-impermeable material is formed by liquid-coating said carrier layer.

21. A cover film covering the image surface of a sublimation thermal-transfer hard copy, comprising:

a transparent carrier layer of an anti-contamination sheet material which is an organic polymeric material having a glass transition temperature not lower than 80° C.; and a layer of gas-impermeable material provided on a surface of said transparent carrier layer opposite to a surface of said carrier layer that contacts the image surface of said sublimation thermal-transfer hard copy.

22. A cover film according to claim 21, wherein said gas-impermeable material includes an ultraviolet absorbing agent.

23. A cover film according to claim 21, wherein said gas-impermeable material is an organic polymeric material having an oxygen permeability not greater than 150 cc/m$^2$−24 hr-atm/25 μm and steam permeability not greater than 100 g/m$^2$−24 hr/25 μm.

24. A cover film according to claim 21, wherein said layer of gas-impermeable material is formed by liquid-coating said carrier layer.

25. A cover film covering the image surface of a sublimation thermal-transfer hard copy, comprising:

a transparent carrier layer made of an anti-contamination sheet material; and a layer of gas-impermeable material provided on a surface of said transparent carrier layer opposite to a surface of said carrier layer that contacts the image surface of said sublimation thermal-transfer hard copy, said gas-impermeable material being an organic polymeric material having an oxygen permeability not greater than 150 cc/m$^2$-24 hr-atm/25 μm and steam permeability not greater than 100 g/m$^2$-24 hr/25 μm.

26. A cover film according to claim 25, wherein said gas-impermeable material includes an ultraviolet absorbing agent.

27. A cover film according to claim 25, wherein said layer of gas-impermeable material is formed by liquid-coating said carrier layer.

28. A cover film covering the image surface of a sublimation thermal-transfer hard copy, comprising:

a transparent carrier layer of gas-impermeable sheet material; and a layer of anti-contamination material provided on a surface of said transparent carrier layer and contacting the image surface of said sublimation thermal-transfer hard copy, said anti-contamination material being an inorganic material, metal or an organic polymeric material having a glass transition temperature not lower than 80° C.

29. A cover film according to claim 28, wherein said gas-impermeable material is an organic polymeric material having an oxygen permeability not greater than 150 cc/m$^2$−24 hr-atm/25 μm and steam permeability not greater than 100 g/m$^2$−24 hr/25 μm.

30. A cover film according to claim 28, wherein said gas-impermeable material includes an ultraviolet absorbing agent.

31. A cover film according to claim 28, wherein said layer of anti-contamination material is formed by liquid-coating said carrier layer.

32. A cover film covering the image surface of a sublimation thermal-transfer hard copy, comprising:

a transparent carrier layer made of an organic polymeric sheet material having an oxygen permeability not greater than 150 cc/m$^2$−24 hr-atm/25 μm and steam permeability not greater than 100 g/m$^2$−24 hr/25 μm; and a layer of anti-contamination material provided on a surface of said transparent carrier layer and contacting the image surface of said sublimation thermal-transfer hard copy.

33. A cover film according to claim 32, wherein said gas-impermeable material includes an ultraviolet absorbing agent.

34. A cover film according to claim 32, wherein said layer of anti-contamination material is formed by liquid-coating said carrier layer.

35. A cover film covering the image surface of a sublimation thermal-transfer hard copy, comprising:

a first layer of transparent organic polymeric sheet material having a glass transition temperature not lower than 80° C.; and a second layer of transparent gas-impermeable sheet material laminated on said first layer.

36. A cover film according to claim 35, wherein said gas-impermeable material includes an ultraviolet absorbing agent.

37. A cover film covering the image surface of a sublimation thermal-transfer hard copy, comprising:

a first layer of transparent anti-contamination sheet material; and a second layer of transparent gas-impermeable sheet material laminated on said first layer, wherein said second layer is made of an organic polymeric material having an oxygen permeability not greater than 150 cc/m$^2$−24 hr-atm/25 μm and steam permeability not greater than 100 g/m$^2$−24 hr/25 μm.

38. A cover film according to claim 37, wherein said gas-impermeable material includes an ultraviolet absorbing agent.

39. A cover film covering the image surface of a sublimation thermal-transfer hard copy, comprising:

an anti-contamination layer having a surface which constitutes a surface of said cover film that faces said image surface; and a gas-impermeable layer attached to an opposite surface of said anti-contamination layer.

* * * * *